US006010987A

United States Patent [19]

Stiefel et al.

[11] Patent Number: 6,010,987

[45] Date of Patent: Jan. 4, 2000

[54] ENHANCEMENT OF FRICTIONAL RETENTION PROPERTIES IN A LUBRICATING COMPOSITION CONTAINING A MOLYBDENUM SULFIDE ADDITIVE IN LOW CONCENTRATION

[75] Inventors: Edward Ira Stiefel, Bridgewater; Jonathan M. McConnachie; Daniel Paul Leta, both of Flemington; Charles Frederick Pictroski, Glen Gardner, all of N.J.

[73] Assignee: Exxon Research and Engineering Co., Florham Park, N.J.

[21] Appl. No.: 08/844,020

[22] Filed: Apr. 18, 1997

Related U.S. Application Data

[63] Continuation-in-part of application No. 08/766,832, Dec. 13, 1996, abandoned.

[51] Int. Cl.[7] ..... C10M 135/00

[52] U.S. Cl. ..... 508/363; 508/367

[58] Field of Search ..... 508/167, 363, 508/367

[56] References Cited

U.S. PATENT DOCUMENTS 4,846,983 7/1989 Ward, Jr. ..... 508/363
4,966,719 10/1990 Coyle et al. .
4,978,464 12/1990 Coyle et al. .
4,995,996 2/1991 Coyle et al. .

OTHER PUBLICATIONS

Shibahara, et al. ; Coord. Chem. Rev. 123, 73–148 (1993).

Doner et al.; International Publication No. WO95/19411, Pub. Jul. 20, 1995 for Int'l. Appl. No. PCT/US95/00242.

*Primary Examiner*—Jacqueline V. Howard
*Assistant Examiner*—Cephia D. Toomer
*Attorney, Agent, or Firm*—L. M. Scuorzo

[57] ABSTRACT

The invention is a method for improving the friction reduction and friction reduction retention performance of a lubricating oil comprising adding to the lubricating oil a trinuclear molybdenum sulfur compound selected from the group of trinuclear molybdenum compounds preferably those having the formulas $Mo_3S_7(dtc)_4$ and $Mo_3S_4(dtc)_4$ and mixtures thereof wherein dtc represents independently selected diorganodithiocarbamate ligands containing independently selected organo groups and wherein the ligands have a sufficient number of carbon atoms among all the organo groups of the compound's ligands are present to render the compound soluble or dispersible in the lubricating oil. Concentrates of the composition are also included in the invention.

14 Claims, 9 Drawing Sheets

ENHANCEMENT OF FRICTIONAL RETENTION PROPERTIES IN A LUBRICATING COMPOSITION CONTAINING A MOLYBDENUM SULFIDE ADDITIVE IN LOW CONCENTRATION

This application is a continuation-in-part of U.S. patent application Ser. No. 766,832, filed Dec. 13, 1996, now abandoned.

FIELD OF THE INVENTION

The present invention relates to a method for the enhancement of friction reduction retention properties in a lubricating composition containing a molybdenum sulfide additive.

BACKGROUND OF THE INVENTION

Molybdenum disulfide is a well known lubricant. Unfortunately, its use as an additive in oils of lubricating viscosity is limited by its insolubility in oil. Consequently, oil-soluble molybdenum sulfur-containing compounds have been proposed and investigated for use a lubricating oil additives.

Oil soluble dinuclear molybdenum sulfide lubricating oil additives are well known in the art. The additives are typically used in concentrations ranging upwards from 500 ppm based on the total weight of the lubricating composition, and often in the presence of supplementary sulfur sources. However, the relatively high cost of molybdenum has stimulated research directed toward identifying molybdenum sulfur compounds that are effective additives at concentrations below that required for the conventional dinuclear additives.

As is known in the art, lubricating oil compositions such as those containing dinuclear molybdenum sulfide additives lose their effectiveness over time when used in an engine. It is believed that one reason for this loss in effectiveness is that the lubricating oil is adversely affected by exposure to $NO_x$ compounds present in the engine's crankcase. Some attempts to cure this deficiency have focused on the incorporation of supplementary sulfur donors and antioxidants such as dibenzyldisulfide derivatives (DBDS). These attempts have not been completely successful.

Consequently, there is a need for lubricating oil additives that are effective in reducing friction at low concentration and that remain effective even after use in an engine, are effective at low concentration, and that retain their friction reduction properties even in the absence of supplementary sulfur sources or antioxidants.

SUMMARY OF THE INVENTION

Figure 1:
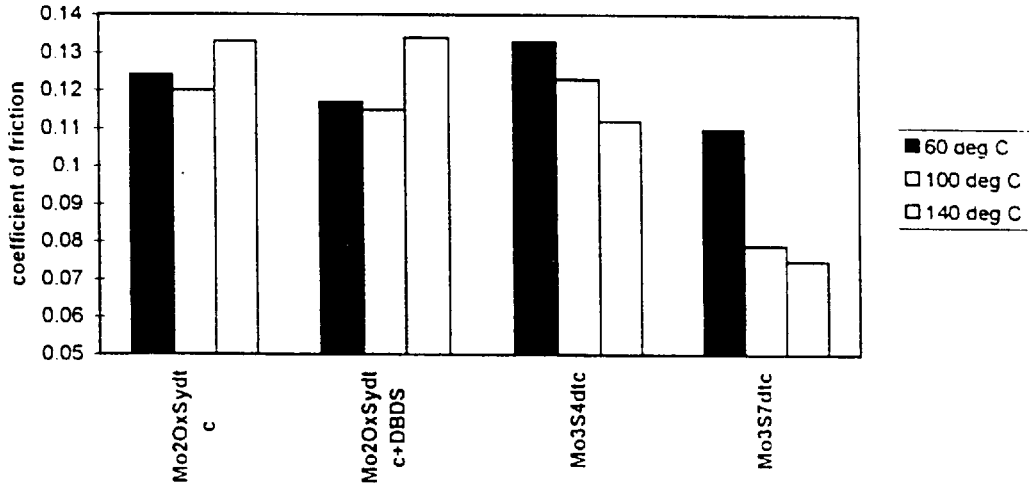
FIG. 1 shows the average coefficient of friction of fresh oils containing dinuclear and trinuclear molybdenum-sulfur compounds of concentration of 150 ppm of Mo based on the weight of the oil.

The present invention is a method for enhancing the friction reduction retention properties of a lubricating composition by adding to a major amount of oil of lubricating viscosity a minor amount of trinuclear molybdenum compounds preferably having the formula $Mo_3S_7(dtc)_4$, $Mo_3S_4(dtc)_4$, and mixtures thereof, wherein dtc represents independently selected diorganodithiocarbamate ligands.

DETAILED DESCRIPTION OF THE INVENTION

Lubricating compositions have been prepared comprising a major amount of an oil of lubricating viscosity and a minor amount of at least one trinuclear molybdenum compound having the formulas $Mo_3S_7(dtc)_4$, $Mo_3S_4(dtc)_4$, and mixtures thereof, where dtc represents independently selected diorganodithiocarbamate ligands. These compounds were surprisingly found to enhance the lubricating properties of the compositions when used at concentrations of as low as 50 ppm molybdenum based on the total weight of the composition. This is a very large reduction in concentration compared to conventional dinuclear molybdenum sulfur additives. Those additives are typically used in concentrations ranging upwards from 500 ppm based on the total weight of the lubricating composition. Additionally, the conventional dinuclear additives require supplementary sulfur donor compounds in order to be as effective an additive as the compounds of the present invention.

The compounds in the present invention were found to enhance the fricton reduction and friction reduction retention properties of lubricating compositions. For example, lubricating compositions containing 150 ppm molybdenum as $Mo_3S_7(dtc)_4$ based on the weight of the lubricating composition were exposed to $NO_2$ treatment. The compounds in the present invention were frictionally active before and after $NO_2$ treatment. By comparison, conventional dinuclear molybdenum sulfide lubricating oil additives were found to be less effective than the trinuclear molybdenum compounds of this invention when the dinuclear compounds were used at a concentration of 150 ppm molybdenum, based on the weight of the composition, before and after exposure to $NO_2$. A lubricating composition's fuel economy and fuel economy retention properties are believed to be related to the composition's friction reduction and friction reduction retention properties. Consequently, lubricating compositions containing trinuclear molybdenum compounds having the formula $Mo_3S_7(dtc)_4$, $Mo_3S_4(dtc)_4$, and mixtures thereof are believed to possess good fuel economy and fuel economy retention properties.

The lubricant compositions of the present invention include a major amount of oil of lubricating viscosity. The oil may be fresh or used and may be selected from vegetable, animal, mineral, or synthetic oils. The oils may range in viscosity from light distillate mineral oils to heavy lubricating oils such as gas engine oil, mineral lubricating oil, motor vehicle oil, and heavy duty diesel oil. The oil may be a refined oil, an unrefined oil, or a re-refined oil.

In general, the viscosity of the oil will range from about 2 centistokes to about 30 centistokes and especially in the range of 5 centistokes to 20 centistokes at 100° C.

The lubricant compositions of the present invention include a minor amount of a trinuclear molybdenum compound, preferably compounds having the formula $Mo_3S_7(dtc)_4$; $Mo_3S_4(dtc)_4$ and mixtures thereof, wherein dtc represents diorganodithiocarbamate ligands and mixtures thereof that are independently selected ligands having organo groups with a sufficient number of carbon atoms to render the compound soluble or dispersible in the oil. Generally at least 21 carbon atoms should be present among all of the compound's ligand's organo groups such as at least 25, at least 30, or at least 35 carbon atoms. Four monoanionic ligands are preferred.

Compounds with the formula $Mo_3S_7(dtc)_4$ and $Mo_3S_4(dtc)_4$, respectively are believed to have a trinuclear molybdenum-sulfur core having the structures

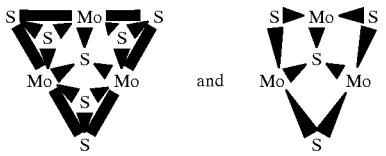

and ligands having the structure

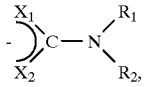

wherein $X_1$ and $X_2$ are independently selected from the group of oxygen and sulfur and $R_1$ and $R_2$ are hydrogen or organo groups that are preferably hydrocarbyl groups, that may be the same or different, are preferably the same, and are preferably selected from alkyl, aryl, substituted aryl, and ether hydrocarbyl groups.

The term "hydrocarbyl" denotes a substituent having carbon atoms directly attached to the remainder of ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the molecule (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, (especially chloro and fluoro), amino, alkoxyl, mercapto, alkylmercapto, nitro, nitroso, sulfoxy, etc.)
3. Hetero substituents, that is, substituents which, while predominantly hydrocarbon in character within the context of this invention, contain atoms other than carbon present in a chain or ring otherwise composed of carbon atoms.

Importantly, the total number of carbon atoms present among all the trinuclear molybdenum compound's ligands' organo groups should be sufficient to render the compound soluble or dispersible in oil. For example, the number of carbon atoms in each organo group will preferably range from 1 to and 100, preferably 1 to 30, and more preferably from 4 to 20.

Without wishing to be bound by any theory, it is believed that two or more trinuclear cores may be bound or interconnected by means of one or more ligands, and the ligands may be multidentate. This includes the case of a multidentate ligand having multiple connections to a single core. Such structures fall within the scope of the invention. Also within the scope of the invention are structures wherein oxygen and/or selenium are substituted for sulfur in the cores.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Oil-soluble or dispersible trinuclear molybdenum compounds can be prepared by reacting in the appropriate liquid(s)/solvent(s) $(NH_4)_2Mo_3S_{13}\bullet n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate liquids/solvent(s) of $(NH_4)_2Mo_3S_{13}\bullet n(H_2O)$, a ligand source such as tetralkylthiuram disulfide, dialkyldithiocarbamate, and a sulfur abstracting agent such as cyanide ions, sulfite ions, or substituted phosphines. Alternatively, a trinuclear molybdenum-sulfur halide salt such as $[M']_2[Mo_3S_7A_6]$, where M' is a counterion, and A is a halogen such as Cl, Br, or I, and may be reacted with a ligand source such as a dialkyldithiocarbamate in the appropriate solvent(s) to form an oil-soluble or dispersible trinuclear molybdenum compound. The appropriate liquid/solvent may for example be aqueous, organic or oxygenate.

The lubricating compositions contain ligand-bearing, trinuclear, molybdenum sulfur compounds in minor effective amounts of preferably from 1 ppm to 2,000 ppm by weight molybdenum from the trinuclear molybdenum compound more preferably 1 to 1000 ppm, more preferably from 5 to 750 ppm, and most preferably from 10 to 300 ppm, all based on the weight of the lubricating composition.

Concentrates of the compound of the present invention in a suitable oleagenous carrier provide a convenient means of handling before their use. Oils of lubricating viscosity as described above, as well as aliphatic, naphthenic, and aromatic hydrocarbons such as toluene and xylene are examples of suitable carriers. These concentrates may contain about 1 to about 90 weight percent of the compound based on the weight of concentrate, preferably from about 1 to about 70 weight percent, and more preferably from about 20 to about 70 weight percent.

Other known lubricant additives may be compatible with the invention and may be used in combination with the compounds of the present invention in amounts known to those skilled in the art to improve fuel economy and fuel economy retention. These include dispersants, detergents, including mixed and single metal detergents, pour point depressants, viscosity improvers, antioxidants, surfactants, and antiwear agents.

The invention will be more fully understood by reference to the following examples illustrating various modifications of the invention which should not be construed as limiting the scope thereof As used herein, ddp represents dialkyldithiophosphate, dtc represents dialkyldithiocarbamate, and coco represents an alkyl chain or mixtures of chains of varying even numbers of carbon atoms of from about typically $C_8$ to $C_{18}$.

EXAMPLE 1

In order to assess the retention of friction reducing properties of the compounds of the present invention, the compounds were admixed into a fully formulated oil, their friction properties determined, then treated with $NO_2$ for a fixed period of time, and then finally, the friction properties determined again. Therefore, the degree of retention of friction reducing properties is determined by measuring the friction properties of the test oil before (fresh) and after $NO_2$ treatment (used). A sample with good retention of friction reducing properties will display minimal, if any, change in its friction properties before and after $NO_2$ treatment.

Conditions for $NO_2$ Treatment

To a test sample of 130 g is added a sludge precursor (150° C. residual of heavy cat cracked naphtha) of 1.15 g. To this mixture is bubbled 1% $NO_2$ in air at 130° C. for 9 hours at a rate of 2.67 liters/hour.

The friction measurement of the $NO_2$ treated oil was determined the following day after $NO_2$ treatment.

Conditions for Boundary Friction Measurement

The boundary friction measurements were determined on a high frequency reciprocating rig (HFRR) at three temperatures (60° C., 100° C. and 140° C.) for 30 minutes at each temperature. The friction was measured using a 6 mm steel ball in a reciprocating motion against a flat steel plate under a load of 4N, a stroke length of 1 mm, and a reciprocating frequency of 20 Hz. The center line average surface roughness for the ball is about 0.01 $\mu$m. The coefficient of friction was sampled every 5 seconds and is quoted as an average friction over the 30 minute period. Fresh oil, disc and ball were used at each temperature.

Compositions with good friction reducing properties provide low coefficient of friction values, i.e., the lower coefficient of friction, the better the friction reducing property.

The friction coefficient at 100° and 140° C. are quoted since these temperatures are considered the most suitable in relating to the performance of molybdenum friction reducing additives in the lubricated engine contacts.

This example demonstrates that lubricating compositions containing compounds having the formula $Mo_3S_7(dtc)_4$ or $Mo_3S_4(dtc)_4$ have superior boundary friction properties compared to lubricating compositions containing dinuclear molybdenum sulfur additives even when the dinuclear additives are used in the presence of supplemental sulfur sources such as DBDS at low molybdenum concentrations such as 150 ppm molybdenum based on the total weight of the compositon. The compounds are also shown to possess better boundary friction enhancement and retention properties than trinuclear molybdenum sulfide compounds that are coordinated with four sulfurs; however, the trinuclear molybdenum compounds coordinated with four sulfur atoms possess enhanced boundary friction and friction retention properties in comparison with dinuclear molybdenum compounds.

Figure 2:
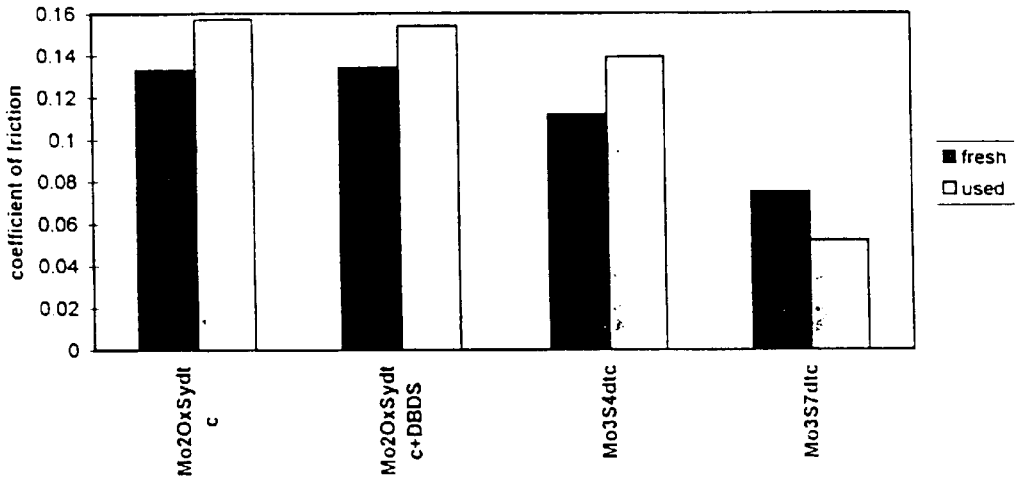
FIG. 2 shows the average coefficient of friction at 140° C. of oils containing molybdenum-sulfur additive at a concentration of 150 ppm before and after $NO_2$ treatment.

FIGS. 1 and 2 show the superiority of the $Mo_3S_7(dtc)_4$ compounds in both boundary friction reduction and friction reduction retention when compared to three other fully formulated oils. Compounds represented by $Mo_2OxS_ydtc_2$ are Sakuralube 155™ and are supplied by Ashai Denka, Japan.

All four lubricating compositions contained 150 ppm of molybdenum as the indicated molybdenum sulfur additive. Additionally, the compositions contained 0.09 wt % phosphorous. The formulation details are summarized in Table 1.

FIG. 1 shows that samples containing $Mo_3S_7(dtc)_4$ exhibit superior boundary friction between 60° C. and 140° C. FIG. 2 shows that the average coefficient of friction at 140° C. remains low, even after exposure to 1% $NO_2$ in air treatment, for the sample containing $Mo_3S_7(dtc)_4$.

All four oils are fully formulated oils containing known lubricant additives, for example, dispersant, anti-wear agent, detergent, viscosity improvers, and anti-oxidants, in proportions known in the art.

EXAMPLE 2

Figure 3:
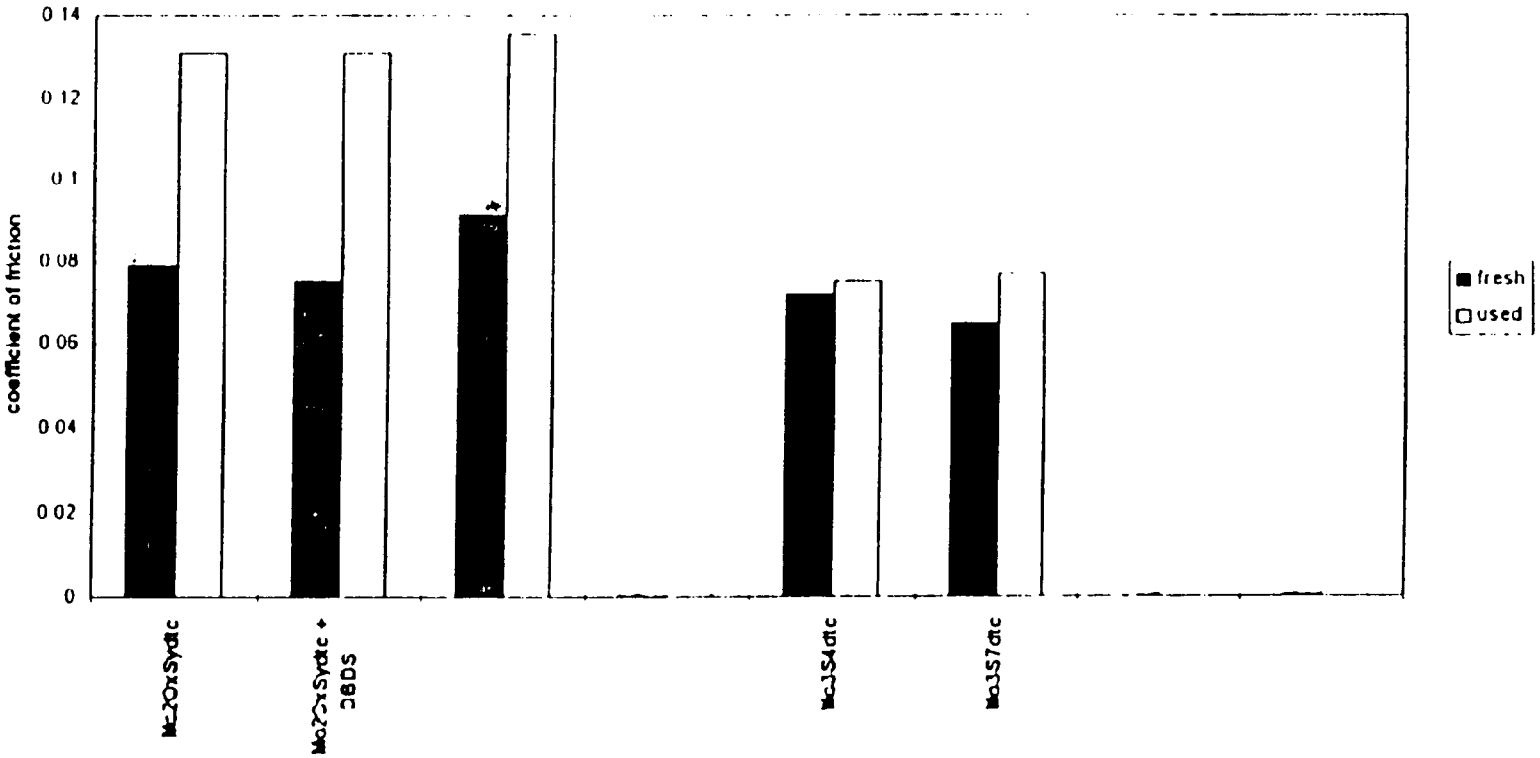
FIG. 3 shows the average coefficient of friction at 100° C. of oils containing molybdenum-sulfur compounds at a concentration of 500 ppm molybdenum before and after $NO_2$ treatment.
Figure 4:
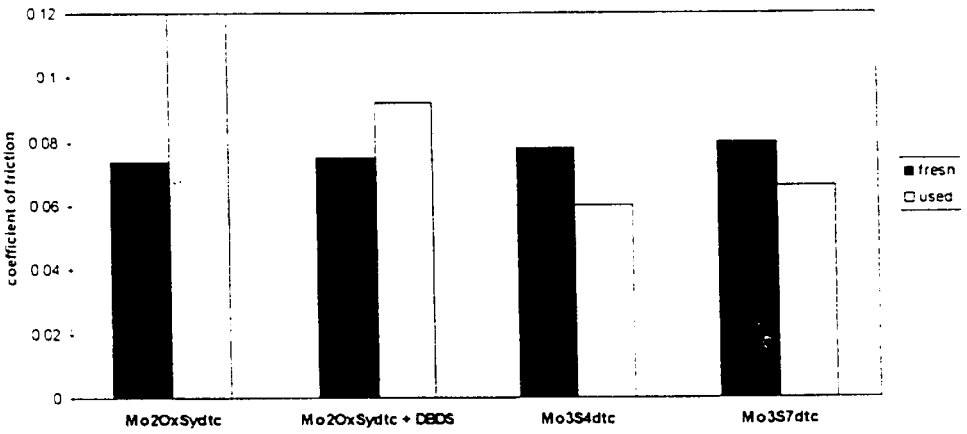
FIG. 4 shows the average coefficient of friction at 100° C. of oils containing molybdenum-sulfur compounds at a concentration of 750 ppm molybdenum before and after $NO_2$ treatment.

This example shows that the trinuclear molybdenum sulfur compositions have superior friction reduction and friction reduction retention properties compared to conventional dinuclear molybdenum sulfide additives even when used at concentrations typically used for the dinuclear additives, for example 500 and 750 ppm of molybdenum. See FIGS. 3 and 4. Formulation details are provided in Table 1.

TABLE 1

| Mo Compounds | $Mo_2O_xS_ydtc$ | $Mo_2O_xS_ydtc$ + DBDS | $Mo3S4dtc_4$ | $Mo3S7dtc_4$ |
|---|---|---|---|---|
| | Mo = 150 ppm & P = 0.09% | | | |
| SAKURALUBE 155 | 0.36 | 0.36 | | |
| $Mo_3S_4DTC_4$ | | | 0.09 | |
| $Mo_3S_7DTC_4$ | | | | 0.12 |
| dibenzyldisulfide | | 0.4 | | |
| | Mo = 500 ppm & P = 0.09% | | | |
| SAKURALUBE 155 | 1.21 | 1.21 | | |
| $Mo_3S_4DTC_4$ | | | 0.31 | |

TABLE 1-continued

| Mo Compounds | $Mo_2O_xS_ydtc$ | $Mo_2O_xS_ydtc$ + DBDS | $Mo3S4dtc_4$ | $Mo3S7dtc_4$ |
|---|---|---|---|---|
| $Mo_3S_7DTC_4$ | | | | 0.42 |
| dibenzyldisulfide | | 0.4 | | |
| | Mo = 750 ppm & P = 0.09% | | | |
| SAKURALUBE 155 | 1.82 | 1.82 | | |
| $Mo_3S_4DTC_4$ | | | 0.46 | |
| $Mo_3S_7DTC_4$ | | | | 0.63 |
| dibenzyldisulfide | | 0.4 | | |

EXAMPLE 3

Resistance to Performance Loss Due to $NO_2$

In order to simulate the loss of frictional benefits of molybdenum additives due to oil aging in an engine several formulated oils containing 500 ppm Mo as either MV822 or $Mo_3S_7((coco)_2dtc)_4$ were degraded via $NO_2$/air sparging at an elevated temperature. In this example, MV822™ is represented by $Mo_2O_2\mathbf{5}_2(dtc)_2$, and is available from the Vanderbilt Chemical Company.

As used herein, "coco" is an alkyl chain or mixtures of chains of varying even numbers of carbon atoms of from about typically $C_8$ to $C_{18}$.

250 ml samples of the oils were held at 130° C. with a sparge of 55 ml/min of 1% $NO_2$ in air for 18 hours with a periodic withdrawl of 20 ml. samples for friction testing.

The frictional performance of the sampled oils was determined using a Cameron-Plint TE77 tribometer. The test protocol uses a 6 mm steel ball in reciprocating motion against a flat steel plate under a normal load of 5 kg, a stroke length of 7 mm, and a reciprocation frequency of 22 Hz. During the test the oil is held for approximately 20 minutes at each of four temperatures 50° C., 80° C., 110° C., and 135° C. while the friction coefficient is measured.

Figure 5:
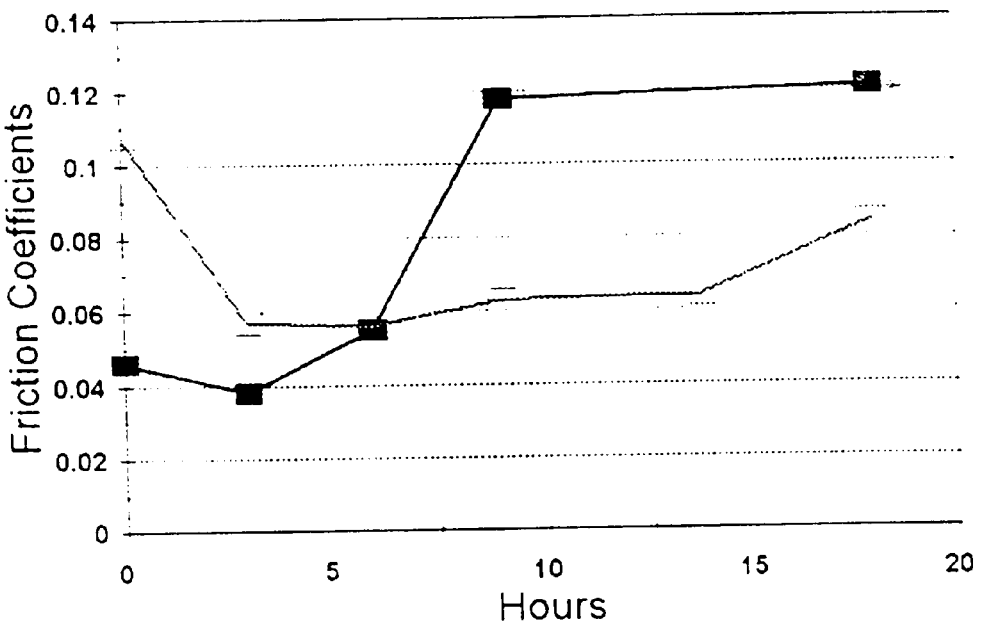
FIG. 5 compares the coefficient of friction at 110° C. of an oil containing a trinuclear molybdenum sulfur compound and a dinuclear molybdenum sulfur compound when both are subjected to $NO_2$ treatment.
Figure 6:
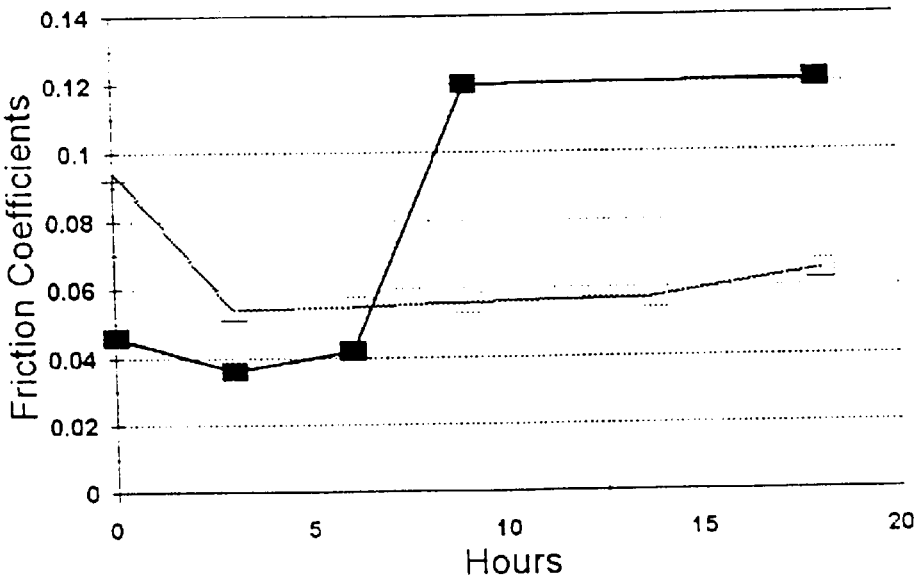
FIG. 6 compares the coefficient of friction at 135° C. of an oil containing a trinuclear molybdenum sulfur compound and a dinuclear molybdenum sulfur compound when both are subjected to $NO_2$ treatment.

The friction coefficients measured at the end of the 110° C. and 135° C. temperature periods as a function of hours of $NO_2$ treatment are shown in FIGS. 5 and 6, respectively. These temperatures are considered significant in relating to the performance of molybdenum friction reducing additives for automotive fuel economy.

It may be seen in FIGS. 5 and 6 that the $Mo_3S_7((coco)_2dtc)_4$ (open squares) trinuclear molybdenum compound demonstrates far superior retention of its friction reduction performance under $NO_2$ oxidation than the dinuclear ($Mo_2O_2S_2(dtc)_2$) additive(shaded squares).

EXAMPLE 4

Performance at Low Concentrations

In order to compare the friction-reducing and anti-wear performance of trinuclear molybdenum compounds with conventional dinuclear molybdenum additives, a series of oils was bench friction and wear tested at various concentrations less than or equal to 500 ppm of Mo in a formulated automotive oil.

The formulations were tested in a Falex Block-on-Ring (BOR) tribometer at 100° C. with a 220 lb. load, a speed of 420 rpm (44 radians/sec.) (0.77 m/s), and a 2 hour test length. Friction coefficients are reported as the end of run value. Data reported includes the block wear scar volume, measured by profilometry and the end of test friction coefficient. The results are shown in Table 2.

TABLE 2

| Concentration (ppm Mo) | Bock Wear Volume $mm^3 \times 100$ | Last Friction Coefficient |
|---|---|---|
| MV822A - $Mo_2O_2S_2(dtc)_2$ | | |
| 0 ppm | 2.77 | 0.123 |
| 50 ppm | 2.45 | 0.105 |
| 75 ppm | | |
| 100 ppm | 1.80 | 0.094 |
| 150 ppm | 0.79 | 0.058 |
| 250 ppm | 0.61 | 0.032 |
| 500 ppm | 0.60 | 0.033 |
| $Mo_3S_7((coco)2dtc)4$ | | |
| 50 ppm | 1.31 | 0.091 |
| 75 ppm | 0.77 | 0.053 |
| 100 ppm | | |
| 150 ppm | 0.45 | 0.037 |
| 250 ppm | | |
| 500 ppm | 0.044 | 0.035 |

Figure 7:
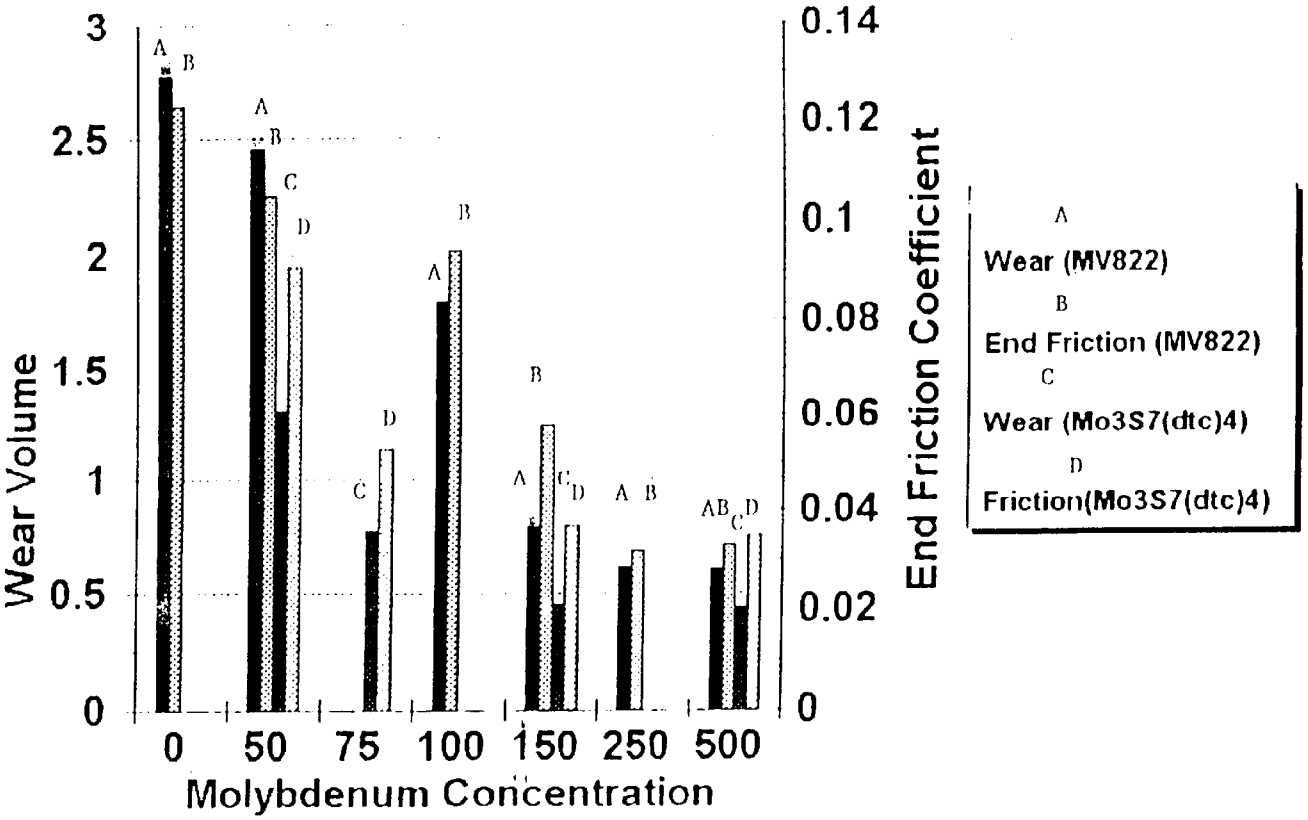
FIG. 7 shows the coefficient of friction and wear for lubricating compositions containing molybdenum-sulfur compounds at different concentrations.

The results are also presented graphically in FIG. 7.

It may be seen that the trinuclear Mo compound provides superior friction and wear performance at low concentrations.

EXAMPLE 5

In order to further test the retention properties of trinuclear Mo compounds and compare them to commercially available dinuclear additives a number of small engine aging runs were performed with periodic sampling and friction and wear performance measurement using a Falex Block-on-Ring tribometer. The compounds were tested in a fully formulated 10W-30 oil that did not contain supplemental antioxidants, i.e., ZDDP was present but Cu, diaryl amines and/or phenols were not included. Three molybdenum containing formulations were examined in this formulation according to the following Test:

| Sample ID for Tables & Graphs | Mo Compound | Mo Concentration Based on the Wt. of the Composition |
|---|---|---|
| A | $Mo_2O_2S_2(dtc)_4$ | 500 |
| B | $Mo_3S_7(coco_2dtc)_4$ | 500 |
| C | $Mo_3S_7(coco_2dtc)_4$ | 50 |

The oils were aged in a 2 cylinder, water-cooled, 12 horse power Honda 'generator engine.' Incidentally, operating conditions were set similar to that of the Sequence III E/III F high temperature oxidation tests. The engine is a four stroke carburated overhead cam engine, and it is attached to a 6.5 kw electric generator. The engine was operated under steady state conditions at 3600 rpm, a sump temperature of 150° C., an air/fuel ratio of 16.5/1 and the power fixed at 4.8 kW. The fuel used was a blend of isooctane 90% and toluene 10%. Fuel consumption during the Test was approximately 3 pounds per hour.

A 2000 g initial lube charge was used with makeup oil being added continuously via a low flow peristaltic pump. Samples were removed every 12 hours for friction and wear measurements. The makeup oil addition is then the combination of the consumption rate (approx. 12 g/hr) and the sample size (150 g) for an average addition rate of approximately 25 g per hour.

The fresh and a number of the withdrawn samples were tested in a Falex Block-on-Ring (BOR) tribometer at 100° C. oil temperature, a 220 lb. load, a speed of 420 rpm (44 radians/sec.) (0.77 m/s), for 2 hours. Friction coefficients are reported as both the end of run value (end friction coefficient) and the average value (average friction coefficient) over the entire 2 hours. Following the testing, block wear volumes are determined by multiple scan profilometry and are presented as $mm^3 \times 100$.

The procedures followed and equipment used in the Falex Block-on-Ring tests were similar to those in ASTM Test G77-83 (Ranking Resistance of Material to Slide Wear Using Block-on-Ring Wear Test).

The friction and wear test results for the three engine aging runs according to the Test are shown in Table 3.

TABLE 3

| SAMPLE | Hours in Engine | Wear Volume $mm^3 \times 100$ | End Friction Coefficient | Average Friction Coefficient |
|---|---|---|---|---|
| A | 0 | 1.55 | 0.036 | 0.052 |
| $Mo_2O_2S_2(dtc)_2$ | 12 | 0.73 | 0.032 | 0.039 |
| 500 ppm Mo | 24 | 1.03 | 0.037 | 0.043 |
| | 36 | 2.02 | 0.060 | 0.062 |
| | 48 | 3.64 | 0.098 | 0.094 |
| | 90 | 3.56 | 0.113 | 0.106 |
| B | 0 | 0.44 | 0.035 | 0.047 |
| $Mo_3S_7(coco_2dtc)_4$ | 96 | 0.80 | 0.031 | 0.036 |
| 500 ppm Mo | 97 | 0.85 | 0.038 | 0.043 |
| | 180 | 1.32 | 0.044 | 0.050 |
| C | 0 | 1.39 | 0.091 | 0.091 |
| $Mo_3S_7(coco_2dtc)_4$ | 22 | 1.81 | 0.097 | 0.099 |
| 50 ppm Mo | 53 | 1.02 | 0.070 | 0.074 |
| | 77 | 1.57 | 0.074 | 0.080 |
| | 84 | 1.81 | 0.089 | 0.092 |
| | 88 | 1.82 | 0.104 | 0.102 |
| | 108 | 1.92 | 0.113 | 0.112 |
| | 124 | 1.57 | 0.108 | 0.110 |
| | 163 | 1.31 | 0.122 | 0.121 |

Figure 8:
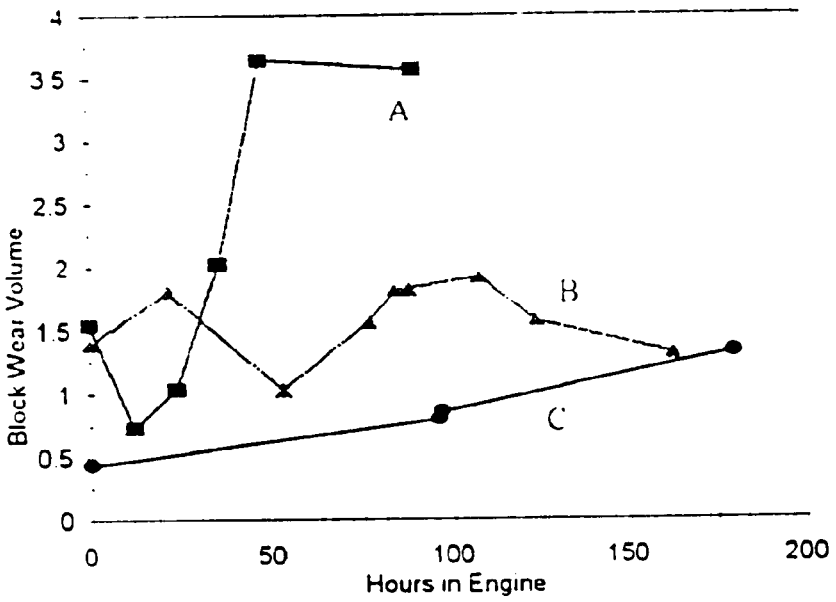
FIG. 8 shows the wear volume of dinuclear and trinuclear molybdenum compounds during the Test.
Figure 9:
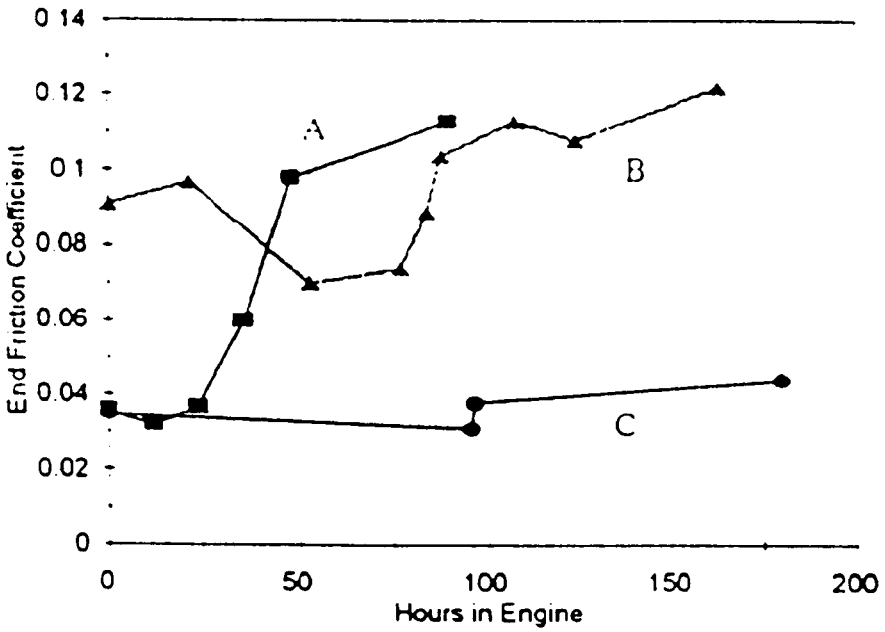
FIG. 9 shows the frictional coefficient of dinuclear and trinuclear molybdenum compounds during the Test.

FIGS. 8 and 9 show that the trinuclear Mo compounds provided superior performance retention as compared to commercial dinuclear Mo additive when tested at equal (500 ppm Mo) concentrations. Even at 50 ppm Mo, the trinuclear compound tested provided significant anti-wear performance retention and a degree of friction benefit and performance retention.

What is claimed is:

1. A method for enhancing the friction-reducing properties and friction reducing retention properties of a lubricating composition, comprising:

adding to a major amount of an oil of lubricating viscosity a minor amount of at least one oil soluble or dispersible trinuclear compound having a trinuclear molybdenum sulfur core.

2. The method of claim 1 where in the compound or compounds are selected from compounds having the formulas $Mo_3S_7(dtc)_4$, $Mo_3S_4,(dtc)_4$, and mixtures thereof, wherein dtc represents independently selected diorganodithiocarbamate ligands containing groups independently selected from hydrogen and organo groups and wherein the ligands have a sufficient number of carbon atoms among all the ligands' organo groups to render the compound soluble in the oil.

3. The method of claim 2 wherein the organo groups are hydrocarbyl groups independently selected from alkyl, aryl, substituted aryl, and ether groups.

4. The method of claim 3 wherein the hydrocarbyl groups are alkyl groups and the number of carbon atoms in each alkyl group ranges from about 1 to about 100.

5. The method of claim 2 wherein the weight of the molybdenum from the trinuclear molybdenum compound ranges from 1 to 1,000 ppm based on the weight of the lubricating composition.

6. The method of claim 2 wherein the trinuclear molybdenum compounds contain a core selected from the group of cores having the structure:

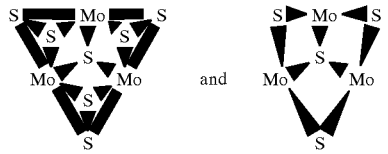

7. The method of claim 2 wherein the trinuclear molybdenum compounds contain ligands having the structure

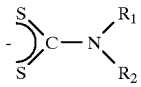

wherein $R_1$ and $R_2$ are independently selected from hydrogen and organo groups.

8. The method of claim 1 wherein the compound's concentration in the oil ranges from about 0.001 to 20 weight percent based on the weight of lubricating oil.

9. The method of claim 7 wherein the total number of carbon atoms among all the ligands' organo groups is at least 21.

10. The method of claim 9 wherein the organo groups are alkyl groups and the number of carbon atoms in each alkyl group ranges from about 1 to about 100.

11. The method of claim 10 wherein the number of carbon atoms in each alkyl group ranges from about 4 to about 20.

12. A concentrate for blending with lubricating oils to provide a lubricating composition having friction reduction retention properties comprising an oleaginous carrier and from about 1 to about 90 weight percent of at least one trinuclear molybdenum compound, based on the weight of the concentrate, the compound selected from the group having the formulas $Mo_3S_7(dtc)_4$, $Mo_3S_4(dtc)_4$, and mixtures thereof, wherein dtc represents independently selected diorganodithiocarbamate ligands containing independently selected organo groups and wherein the ligands have a sufficient number of carbon atoms among all the ligands' organo groups to render the additive soluble in the oil.

13. The concentrate of claim 12 wherein the oleaginous carrier is selected from base stock, animal oils, mineral oil, vegetable oils and synthetic oils, and mixtures thereof.

14. A method for enhancing the friction-reducing properties and friction reducing retention properties of a lubricating composition according to the ASTM Test G77-83 comprising:

adding to a major amount of an oil of lubricating viscosity a minor amount of at least one oil soluble or dispersible trinuclear compound having a trinuclear molybdenum sulfur core.

* * * * *